US006146142A

United States Patent [19]

Nuutinen

[11] Patent Number: 6,146,142

[45] Date of Patent: Nov. 14, 2000

[54] METHOD AND APPARATUS FOR TRAINING SHOOTING

[76] Inventor: Asko Nuutinen, Torpankuia 1 C 16, FIN-40740 Jyväskylä, Finland

[21] Appl. No.: 08/913,898

[22] PCT Filed: Mar. 11, 1996

[86] PCT No.: PCT/FI96/00149

§ 371 Date: Sep. 15, 1997

§ 102(e) Date: Sep. 15, 1997

[87] PCT Pub. No.: WO96/39608

PCT Pub. Date: Dec. 12, 1996

[30] Foreign Application Priority Data

Mar. 14, 1995 [FI] Finland ..... 951194

[51] Int. Cl.[7] ..... F41G 3/26

[52] U.S. Cl. ..... 434/20; 434/19; 434/23; 434/16; 273/371

[58] Field of Search ..... 434/11, 16, 17, 434/18, 19, 20; 273/371, 372, 370, 381

[56] References Cited

U.S. PATENT DOCUMENTS 4,514,621 4/1985 Knight et al. ..... 273/372
4,787,291 11/1988 Frohock, Jr. ..... 89/41.22
4,955,812 9/1990 Hill ..... 434/16
5,026,158 6/1991 Golubic ..... 356/22
5,374,986 12/1994 Solinsky ..... 356/4

*Primary Examiner*—Jessica J. Harrison
*Attorney, Agent, or Firm*—Fildes & Outland, P.C.

[57] ABSTRACT

A method and apparatus for developing shooting skills that take into account the effects of wind on the trajectory of a bullet. The method includes the step of entering basic shooting data into a central unit, measuring force and direction of the wind with at least one wind indicator, feeding the measured force and direction of the wind to the central unit, analyzing the measured force and direction of the wind and the entered data to determine the effects of the wind on the trajectory of the bullet and transmitting the effects of the wind to a marksman. The apparatus includes at least one wind indicator for measuring force and direction of the wind. A central unit is provided to allow entry of basic shooting data. The central unit also collects and analyzes the measured force and direction of the wind with the entered data. The data analyzed by the central unit is transmitted to the marksman through a terminal which tells the marksman what effects the wind will have on the trajectory of the bullet.

12 Claims, 1 Drawing Sheet

METHOD AND APPARATUS FOR TRAINING SHOOTING

The object of the invention is a method for practising shooting, in which method the force and the direction of the wind are shown by at least one wind indicator and its effect on the trajectory of the bullet is determined.

Further, the object of the invention is an apparatus for practising shooting, which apparatus includes at least one wind indicator for showing the direction and force of the wind.

BACKGROUND OF THE INVENTION

In shooting, the wind has a significant effect on the trajectory of the bullet. The effect of the wind is particularly pronounced in rifle and small-bore rifle shooting. It is possible for the marksman to observe the behaviour of the wind optically from so called wind vanes while shooting. The material, surface area, and location or location levels of wind vanes are separately defined in the rules governing shooting. During sighting shots, the marksman observes the wind conditions by following the movements of the wind vanes. At the same time, the marksman tries to ascertain during sighting shots, how much the position of the vane may alter and still allow him to hit the desired point. During a competition, the marksman must either wait until the wind vanes are in the same position as during the sighting shots, or else must try to take changes in wind conditions into account, either by aiming to the side, i.e. taking a deflection, or by moving the sights against the wind. The effect of the wind may be not only lateral, but also vertical, because wind rotates, and often changes its direction due to differences in level between the shooting ranges and the surrounding ground, such as dividing embankments or protective embankments. Following and head winds also affect the trajectory of a bullet in different ways. It is very difficult to master wind conditions by means of wind vanes, and it demands not only skill from the marksman, but also long experience and practice.

The intention of this invention is to create a method and apparatus, by means of which it is possible to practise allowing for the effect of the wind and following the position of the wind vanes during shooting.

It is characteristic of the method in accordance with the invention, that basic data are fed into the central unit, that wind sensors are used as wind indicators, which measures the force and direction of the wind, and that the values measured are taken to the central unit, in which the relevant wind data and the basic data on shooting fed into the central unit are analysed and, on the basis of the result obtained, the effect of the wind conditions on the trajectory of the bullet are shown on at least one terminal.

It is further characteristic of the apparatus in accordance with the invention, that the wind indicator is a wind sensor, by means of which it is possible to measure the velocity and direction of the wind, and that the apparatus includes a central unit, into which it is possible to feed the basic data on shooting, for collecting and analysing the measured wind data, and at least one terminal for displaying the data analysed by the central unit.

The essential idea of the invention is that the data on the direction and velocity of the wind are measured by means of wind sensors, and that the data in question are led through data collection and processing equipment to a terminal, with the aid of which the effect on the wind on the trajectory of the bullet can be clearly displayed to the marksman. Further, the idea is that a display device, by means of which the effect of the wind can be graphically illustrated, can be used as the terminal.

The advantage of the invention is that the marksman can practice reading the wind conditions with the aid of the wind vanes, without having the possible accompanying mistakes in shooting made by the marksman. A further advantage of the invention is that the marksman can, for example, use the invention to ascer- tain when the wind vanes are in a suitable position, so that the shot would be sufficiently good without deflection or moving the sights. An additional advantage is that with the aid of the apparatus equipped with a display device, the marksman can learn where the shot would strike, if he were to aim at the centre of the firing table, or correspondingly, where he should aim to hit the centre of the target.

BRIEF DESCRIPTION OF THE DRAWING

The invention is described in greater detail in the accompanying drawings, in which.

DESCRIPTION OF THE PREFERRED EMBODIMENT

Figure 1:
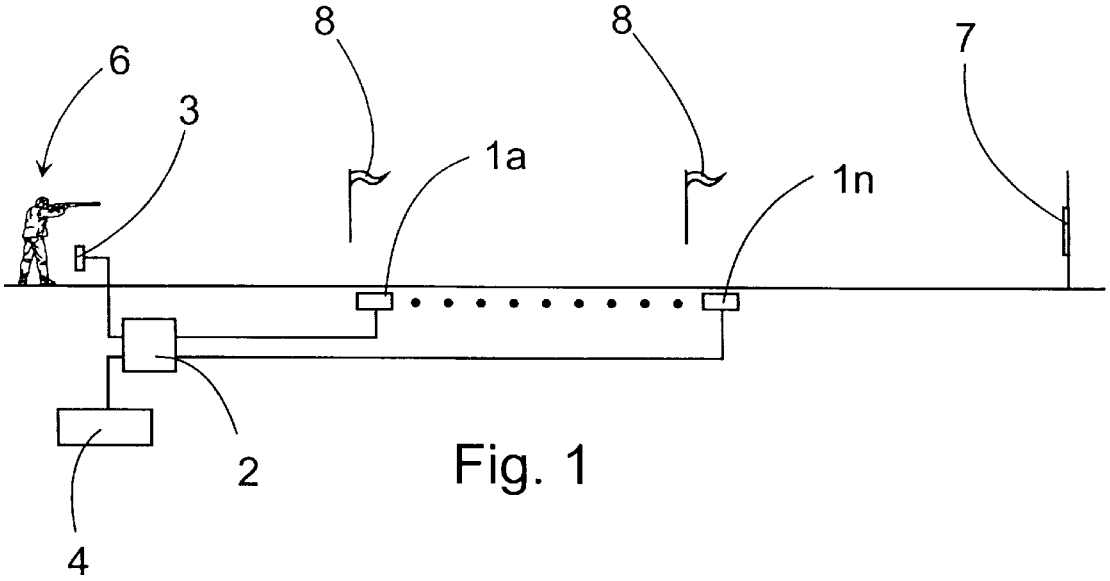
FIG. 1 is an environmental view illustration a shooting range and the apparatus in accordance with the invention.

FIG. 1 illustrates a shooting range and shows schematically an apparatus in accordance with the invention. As is known, the shooting range or firing is an elongated area where a marksman 6 stands at one end and aims, then shoots, at a target 7 located at the other end. The apparatus includes the necessary number of wind sensors 1*a*–1*n*, which measure the direction and velocity of the wind. The desired number of wind sensors 1*a*–1*n* are placed on the shooting range at the desired locations, for example at the same levels as the wind vanes. The wind sensors 1*a*–1*n* can measure the vertical direction of the wind as well as the lateral direction. The wind sensors 1*a*–1*n* are, as such, of a known construction, and for that reason they are not dealt with here in greater detail. The data measured from the wind by wind sensors 1*a*–1*n* is transmitted to the central unit 2 in a manner that is, as such, known, for example through a cable or possibly also by radio. The wind data are analysed in the central unit 2 and the result of the analysis is led to the terminal 3. The basic data on shooting, for example the weight of the shot and its initial velocity, the distance of shooting, etc. are entered in the central unit 2. From the relevant basic data and the measured wind data, the central unit 2 calculates the effect of the wind on the shot. The operation of the apparatus is controlled by means of the control equipment 4.

At its simplest, the apparatus only requires the wind sensors 1*a* –1*n*, the central unit 2, and the terminal 3. In this case, practising takes place in such a way that the wind values are calibrated into the central unit 2, when the wind vanes are is the desired position. Terminal 3 could then be at its simplest a device giving an audible signal, which would alarm when the wind values change excessively from the aforementioned calibration value. When practising, the marksman could follow the position of the wind vanes and, at the same time, listen for the audible signal from the terminal.

Figure 2:
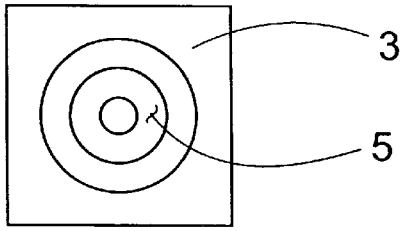
FIG. 2 shows schematically the display device of the apparatus in accordance with the invention.

If a display device is used as the terminal 3, it can display the wind data either continuously, or at intervals selected by the marksman. By means of the control equipment 4, it is possible to practise reading the wind optically from the vanes, for example, by the marksman pressing the button of the control device 4, when in reality he would fire a shot. The display device then gives a hit value, where the shot would have struck in the wind conditions in question. FIG. 2 shows a display device acting as the terminal 3, in which there is a graphically presented target and the hit position 5 that would have occurred under the wind conditions in question, and which can also move in real time as the wind conditions change. The display device can also show the point that the marksman should aim at, to hit the centre of the target under the prevailing wind conditions.

The wind can be shown on the display device as vectors, which illustrate the direction and velocity of the wind. For the sake of illustration, the colour of the display can change, when the wind conditions alter more than certain limit values recorded in the memory. The apparatus can also be connected to an electric shooting target, when the marksman sees from the display device his real hit value and, in addition, the movement in the hit position of the bullet caused by the wind.

By means of the control equipment 4, the central unit 2 can be controlled and programmed in many ways. It is possible, for instance, to record in the memory of the equipment the wind data and the hit values for a desired period, when the equipment can be used for example in the analysis of various competitive performances. In addition, the equipment can be used to measure and test the wind conditions of different shooting ranges. For example, a microcomputer can be used as the central unit 2, the monitor of the computer as the terminal 3, and the keyboard of the microcomputer as the control device 4.

The drawing and the accompanying description are only intended to illustrate the concept of the invention. The invention can vary in details within the framework of the Patent Claims. Thus, if desired, several terminals 3 and control devices 4 can be connected to a single central unit 2. Further, the central unit 2, the terminal 3, and the control device 4 can each be separate units or else they can be connected to each other.

It is advantageous to use at least two wind sensors over the shooting distance, because the wind conditions are not stable over the entire distance.

What is claimed is:

1. A method for developing the shooting skills of a marksman at a shooting range that takes into account the effects of wind on the trajectory of a bullet from a rifle, said method comprising the steps of:

entering basic shooting data into a central unit;

measuring force and direction of the wind with at least one wind indicator disposed along the shooting range between the rifle and a target;

communicating a value of the measured force and direction of the wind to the central unit;

analyzing the measured force and direction of the wind and the entered data to determine the effects of the wind on the trajectory of the bullet; and showing the effects of the wind on the trajectory of the bullet to a marksman through a terminal.

2. A method as in claim 1 wherein the force and direction of the wind are measured by two or more wind sensors separated by a distance from each other.

3. A method as in claim 2 wherein the step of transmitting the effects of the wind on the trajectory of the bullet to the marksman includes transmitting an audible signal that indicates the effects of the wind on the trajectory of the bullet.

4. A method as in claim 2 wherein the step of transmitting the effects of the wind on the trajectory of the bullet to the marksman includes the step of graphically displaying the effects of the wind on the trajectory of the bullet through the terminal.

5. A method as in claim 4 wherein the step of graphically displaying the effects of the wind includes the step of displaying on a display device in the terminal a hit position of the bullet on the target such as it would be without moving the sights.

6. A method as in claim 4 wherein the step of graphically displaying the effects of the wind includes the step of displaying on a display device in the terminal an aiming point which should be aimed at in relation to the target, so that the effect of the wind is eliminated.

7. A method as in claim 4 wherein the step of graphically displaying the effects of the wind includes the step of displaying on a display device in the terminal a hit position of the bullet after firing and the change in the hit position caused by the wind.

8. An apparatus for developing the shooting skills of a marksman at a shooting range that takes into account the effects of wind on the trajectory of a bullet from a rifle, said apparatus comprising:

at least one wind indicator disposed along the shooting range between the rifle and a target for measuring direction and force of the wind;

a central unit for entering basic shooting data and collecting and analyzing the measured direction and force of the wind and the entered basic shooting data; and at least one terminal for presenting the data analyzed by the central unit to a marksman.

9. An apparatus as in claim 8 further comprises at least one control equipment connected to the central unit for controlling the central unit.

10. An apparatus as in claim 8 wherein the terminal includes a device for transmitting an audible signal when the measured force and direction of the wind and the entered data are in a particular relation to one another.

11. An apparatus as in claim 8 wherein the terminal includes a display device for graphically displaying the effects of the wind on the trajectory of the bullet.

12. An apparatus as in claim 8 wherein the wind indicator is a wind sensor that measures the velocity and direction of the wind.

* * * * *